US008510878B2

(12) United States Patent
Wang

(10) Patent No.: US 8,510,878 B2
(45) Date of Patent: Aug. 20, 2013

(54) PORTABLE, FOLDABLE YOGA/MEDITATION MAT

(75) Inventor: Xujia Wang, Millstone, NJ (US)

(73) Assignee: OADED LLC, Millstone, NJ (US)

( * ) Notice: Subject to any disclaimer, the term of this patent is extended or adjusted under 35 U.S.C. 154(b) by 0 days.

(21) Appl. No.: 13/411,530

(22) Filed: Mar. 3, 2012

(65) Prior Publication Data

US 2012/0233772 A1 Sep. 20, 2012

Related U.S. Application Data

(60) Provisional application No. 61/452,777, filed on Mar. 15, 2011.

(51) Int. Cl.
*A47G 9/06* (2006.01)

(52) U.S. Cl.
USPC ..... 5/417; 5/419; 5/420

(58) Field of Classification Search
USPC ..... 5/417, 419, 420, 640, 657
See application file for complete search history.

(56) References Cited

U.S. PATENT DOCUMENTS 4,375,111 A * 3/1983 Hall ..... 5/419
4,868,940 A * 9/1989 Masadi ..... 5/417
4,985,952 A * 1/1991 Edelson ..... 5/722
5,950,260 A * 9/1999 Dees ..... 5/420

* cited by examiner

*Primary Examiner* — Fredrick Conley

(57) ABSTRACT

A portable, foldable yoga mat/meditation mat includes a plurality of linear indentations so that the mat can be folded into various sizes and used in various aspects. For example, when the mat is unfolded along all linear indentations (i.e., in a completely unfolded state), the mat could be used as a typical yoga mat. When the mat is folded along some but not all linear indentations, the mat could be used as a comfortable meditation or sitting mat. When the mat is folded along all linear indentations, the folded mat becomes a portable sized block which can be easily carried in either customized or non-customized carriers and conveniently stored with other regular shaped items.

18 Claims, 16 Drawing Sheets

FIG. 2
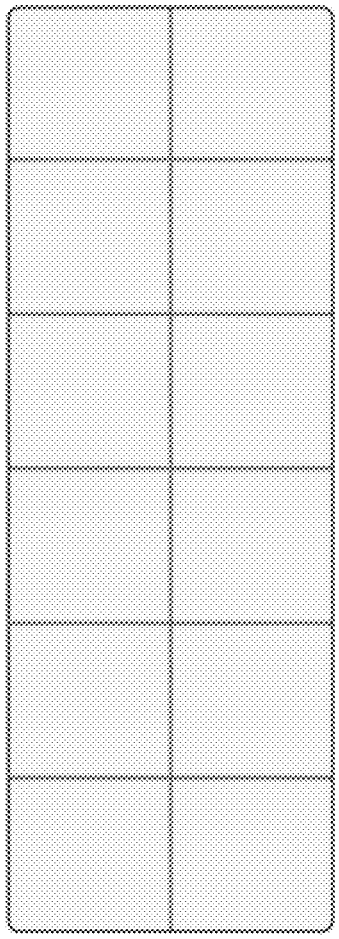
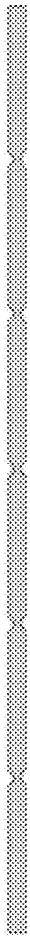
FIG. 3
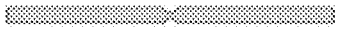
FIG. 4

FIG. 9
FIG. 10
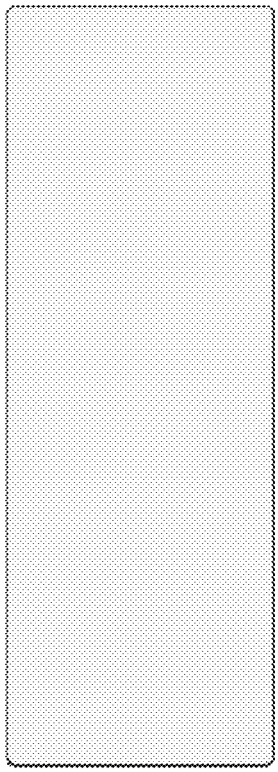
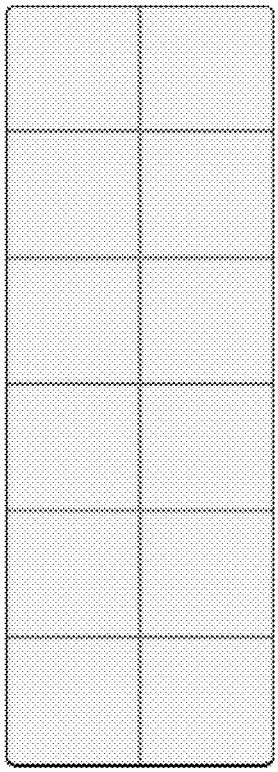
FIG. 11
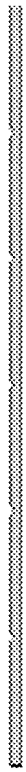
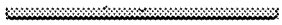
FIG. 12

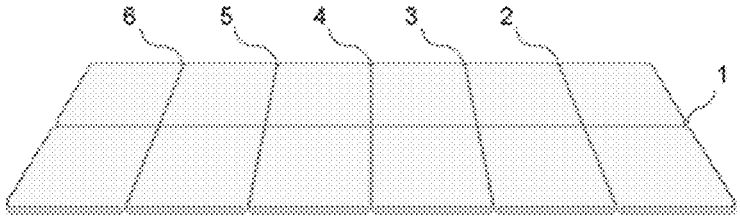
FIG. 13
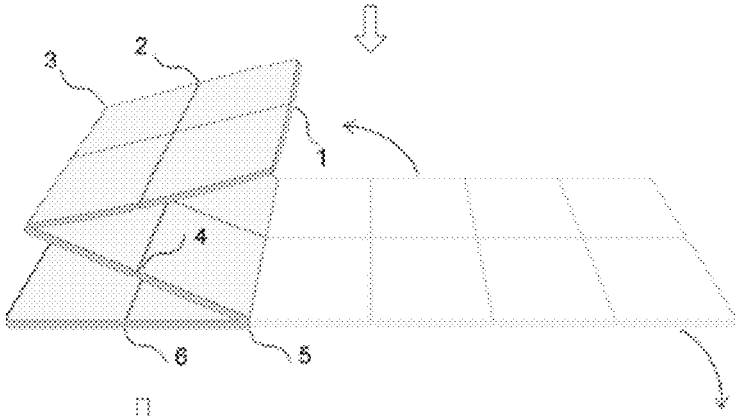
FIG. 14
FIG. 15
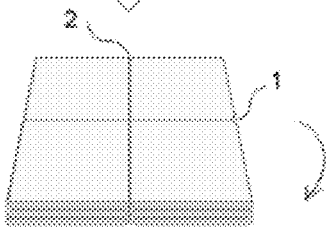
FIG. 16
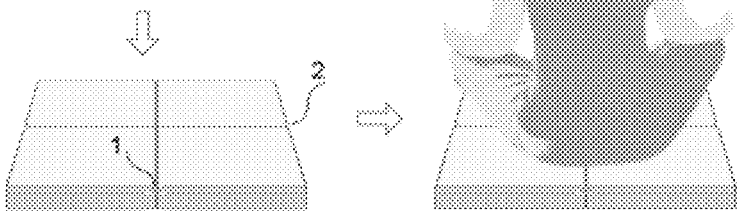
FIG. 17

PORTABLE, FOLDABLE YOGA/MEDITATION MAT

CROSS-REFERENCE TO RELATED APPLICATION

This application claims priority to U.S. Provisional Application No. 61/452,777, filed on Mar. 15, 2011, the contents of which are incorporated by reference in its entirety.

BACKGROUND OF THE INVENTION

As one of the most popular practices in the world, Yoga attracts millions of people every day. In the United States alone, more than 15 million people practice yoga on a regular basis (Yoga Journal, 2008 "Yoga in America" Market Study, February 2008). A yoga mat is usually used to practice yoga. However, most people have great difficulty in carrying their yoga mats around or storing their yoga mats because a comfortable yoga mat measures at least ⅛ inch thick and it needs to be rolled up. The rolled up yoga mats are awkward in shape and size because they are usually long rolls measuring more than 24 inches. While yoga mat carriers and bags do exist, they do not change the awkward shape and size of the rolled up yoga mats. And they have to be carried separately as a long roll in addition to other personal belongings a yoga practitioner also need (e.g. purses, backpacks, towels, water bottle, etc.) In addition, there are a lot of efforts required for a person to carefully roll and unroll a yoga mat just to get it in and out of the existing yoga mat carriers and bags because these carriers or bags are also awkwardly shaped as a long roll. Furthermore, for the yoga practitioners who are avid travelers, the rolled up yoga mats are almost impossible to fit in any purse, backpack or carry-on luggage bags, thus making them very difficult to travel with. Another problem with the awkward shape of the rolled up yoga mats is that they are very difficult to store since they cannot be easily stacked and the long rolls are too easy to move around. Last but not least, the rolled up yoga mat makes maintaining the mat hygiene a difficult task since rolling the mat means the side touching the floor gets rolled in with the side touching the body. Any germs/dirt on the floor will easily get transmitted to both sides of the mat, making cleaning a challenging task. Since most people practice yoga with their bare feet on the mat and with their whole body touching the mat during certain poses, hygiene is a big concern especially when doing yoga in a public place such as gym or yoga studio.

In addition, a large number of yoga practitioners also practice meditation, with some practitioners practice meditation regularly at the beginning and/or the end of the yoga session. Meditation practice also requires a meditation mat or cushion which its length is roughly one third of the regular yoga mat with similar width and thicker cushioning to allow comfortable sitting. Thus many yoga/meditation practitioners have to prepare two different types of mats for their yoga and meditation practices separately.

The present invention is a portable, foldable yoga/meditation mat which can be easily folded/unfolded using the linear indentations, and thus fundamentally changes the size and shape of a folded yoga mat from a long roll into a portable sized block. This invention of a portable, foldable yoga mat is simple to use and can easily fit into either non-customized purses, briefcases, totes, backpacks, carry-on luggage etc. or customized bags or straps, and thus can be easily carried around with other personal belongings. The portable, foldable yoga mat of the present invention can also be easily stored by stacking them on top of each other or with other regular shaped items such as storage boxes. The present invention also helps to achieve better hygiene in yoga practice since the folding ensures one side (facing the floor) does not touch the other side (facing the practitioner). Furthermore, it can also be folded along some but not all linear indentations to form a nicely sized meditation mat. The linear indentations can also serve as visual coordinates to assist body alignment in yoga practice. The convenient solutions are achieved while preserving all of the desired qualities (such as a non-slip surface and a sufficient cushioning) needed from a yoga or meditation mat.

BRIEF SUMMARY OF THE INVENTION

Applicant's invention comprises a portable, foldable yoga mat/meditation mat that is able to be folded using the linear indentations to transform the mat into various sizes and used in various aspects. The present invention fundamentally changes the size and shape of a folded yoga mat from a long roll into a portable sized block. The linear indentations are embossed on the same integral piece of mat material from which the mat is manufactured and are created by using embossing techniques including high frequency embossing techniques, heat embossing techniques or other types of indenting techniques.

The portable, foldable yoga mat/meditation mat of this invention is washable and maintaining hygiene of the mat is easy. Unlike rolled up yoga mat, the folding design of the present invention ensures one side of the mat (facing the floor) does not touch the other side (facing the practitioner). Thus cleaning and maintaining the mat hygiene is easier to achieve than the rolled up mat which one side contaminates the other when rolling the mat. The present invention also easily folds and unfolds along linear indentations. Unlike the existing rolled up yoga mats that have to be either carried under armpit or using a customized yoga mat carrier/bag, the present invention of portable, foldable yoga mat can be simply put into a non-customized purse, backpack, bag, luggage, tote etc. just as a person would with a large book. If desired, it can also be carried with a customized bag, carrier or strap to further secure the shape and size of the folded yoga mat of this invention. Furthermore, it can be easily stored as it is shaped as a block, so it can be stacked on top of each other or stacked with other regular storage boxes etc.

The portable, foldable yoga mat of the present invention can also be used as a meditation mat. For example, it can be easily transformed into a nicely sized meditation mat by simply folding the mat along some but not all linear indentations (e.g. two or more horizontal linear indentations), thus providing yoga practitioners who also practice meditation the convenience of carrying only one mat for both yoga and meditation practices.

An additional benefit of the present invention is the liner indentations themselves can also serve as visual coordinates to assist body alignment during yoga practice. In some embodiments, the liner indentations are touch felt so that a practitioner can feel the lines without looking down on the mat to assist their alignment in doing yoga poses.

In one embodiment, the invention features a generally rectangular yoga mat that includes an elongated surface and a plurality of linear indentations embossed on the elongated surface. The plurality of linear indentations includes at least one horizontal linear indentation and at least one vertical linear indentation, and renders the yoga mat foldable. As used herein, a "vertical linear indentation" refers to an indentation that is substantially parallel to a length of the mat in an unfolded state and a "horizontal linear indentation" refers to an indentation that is substantially parallel to a width of the mat in an unfolded state.

In another embodiment, the invention features a yoga mat that includes a one-piece mat body having a plurality of linear indentations and a plurality of panels formed by the plurality of linear indentations. The plurality of linear indentations includes at least one horizontal linear indentation and at least one vertical linear indentation. The exercising mat is foldable along at least some of the linear indentations.

The invention can include one or more of the following optional features.

In some embodiments, the mat has a rectangular shape in an unfolded state.

In some embodiments, the mat has a rectangular block shape in a folded state.

In some embodiments, the mat has a square block shape in a folded state.

In some embodiments, at least some (e.g., all) of the plurality of panels have a rectangular shape.

In some embodiments, at least some (e.g., all) of the plurality of panels have a square shape.

In some embodiments, the mat has a major surface having a first surface area in an unfolded state and a major surface having a second surface area in a folded state, and the second surface area is at most ⅓ (e.g., at most ⅙, at most ⅛, at most 1/10, at most 1/12, or at most 1/14) of the first surface area.

In some embodiments, the mat is made from polyvinyl chloride, thermoplastic elastomer, rubber, rubber-like material, ethylene vinyl acetate, polymer environmental-friendly resin, cotton, microfiber, polyester, wool, or a moisture absorbent fabric.

In some embodiments, the mat is made from polyvinyl chloride, thermoplastic elastomer, rubber, rubber-like material, ethylene vinyl acetate or polymer environmental-friendly resin with a middle fabric layer being inserted between and adhered to two layers of mat material. The middle fabric layer is made from polyester, nylon or a resilient fabric to further strengthen the mat and to prevent ripping at the folding lines (i.e. the linear indentations). The linear indentations are embossed on either the top or the bottom layer of mat material or both with the depth of indentations not exceeding ⅘ of the layer of the mat material.

In some embodiments, the linear indentations are formed by embossing. For example, the linear indentations can be formed by using high frequency embossing techniques or heat embossing techniques, or other suitable indenting techniques. The depth and width of the linear indentations are adjusted according to the thickness, material and construction of the mat so as to render the yoga mat foldable while maintaining the yoga mat as one integral piece.

In some embodiments, the linear indentations are embossed on both sides of the mat while in other embodiments, the linear indentations are embossed on only one side of the mat. In some embodiments, the linear indentations further serve as visual or touch felt coordinates to assist body alignment in yoga practice.

In some embodiments, when the mat is in a folded state, the mat is capable of being inserted into a customized bag, carrier or strap.

In some embodiments, the mat is capable of being folded into different sizes using the linear indentations, and a structure foldable at least twice. In some embodiments, the mat has a structure foldable at least six times and one folded state of the mat is capable of being used as a comfortable meditation mat.

There has thus been outlined, rather broadly, the more important features of the invention in order that the detailed description thereof that follows may be better understood. There are, of course, additional features of the invention that will be described hereinafter and which will form the subject matter of the claims appended hereto.

In this respect, before explaining the invention in detail, it is to be understood that the invention is not limited in its application to the details of construction and operation set forth in the following description or illustrated in the drawings. The invention is capable of other embodiments and of being practiced and carried out in various ways. For example, the present invention could be easily adapted as a mat for Pilates, stretching or other suitable exercises using a mat. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

OBJECTS OF THE INVENTION

Accordingly, the mat of the present include at least the following objects and advantages:

It is an object of the present invention to provide a new and improved portable, foldable yoga mat which is easily and simply folded using linear indentations into a portable sized block to provide easy and effortless carrying and storing.

The second object of the invention is to provide a new and improved portable, foldable yoga mat that can fit into and be carried with either non-customized bags, purses, totes, backpacks etc. or customized bags, carriers or straps. The existing yoga mats have to be carried in customized yoga mat carriers or bags.

The third object of the invention is to provide a new and improved portable, foldable yoga mat that has improved hygienic design so that the side of the mat touching the floor does not touch the side of the mat facing the practitioner's body. Unlike the rolled up mat, the germs/dirt on the floor will not get easily transmitted from one side to the other with the folding design of the present invention.

The fourth object of the invention is to provide a solution for the practitioners who practice both yoga and meditation regularly. Instead of requiring two different types of mats for yoga and meditation, the present invention provides a mat that can be easily used for both and the transformation from a yoga mat to a meditation mat is effortless by simply folding the mat along some but not all linear indentations.

The fifth object of the invention is to provide a new and improved portable, foldable yoga mat that the linear indentations on the mat can also serve as visual or touch felt coordinates for body alignment.

The sixth object of the invention is to provide a new and improved portable, foldable yoga mat/meditation mat which has all the functions described in the above three objects while preserving all the advantages of existing yoga mat and meditation mat, such as mat material selection, a non-slip surface and a sufficient cushioning to provide support.

These, as well as other objects of the invention, will become obvious from the following description in which:

BRIEF DESCRIPTION OF THE DRAWINGS

FIG. 2 is an elevational view of the top side of the invention, illustrated in a flat configuration, the bottom elevational view being a mirror image thereof;

FIG. 3 is an elevational view of the left-side of the invention, illustrated in a flat configuration, the right-side elevational view being a mirror image thereof;

FIG. 4 is an elevational view of the front side of the invention, illustrated in a flat configuration, the rear elevational view being a mirror image thereof;

FIG. 9 is an elevational view of the top side of the alternate form of the invention shown in FIG. 8, illustrated in a flat configuration, showing the linear indentations on top side of the mat;

FIG. 10 is an elevational view of the bottom side of the alternate form of the invention shown in FIG. 8, illustrated in a flat configuration, showing no linear indentations on bottom side of the mat;

FIG. 11 is an elevational view of the left-side of the alternate form of the invention shown in FIG. 8, showing the linear indentations on one side of the mat, illustrated in a flat configuration, the right-side elevational view being a mirror image thereof;

FIG. 12 is an elevational view of the front of the alternate form of the invention shown in FIG. 8, showing the linear indentations on one side of the mat, illustrated in a flat configuration, the rear elevational view being a mirror image thereof;

FIGS. 13-16 are perspective views of the invention, showing different forms of use;

FIG. 17 is a perspective view of the invention, illustrated in an alternate, partially folded, flat configuration with the environment shown.

DETAILED DESCRIPTION OF THE INVENTION

Figure 1:
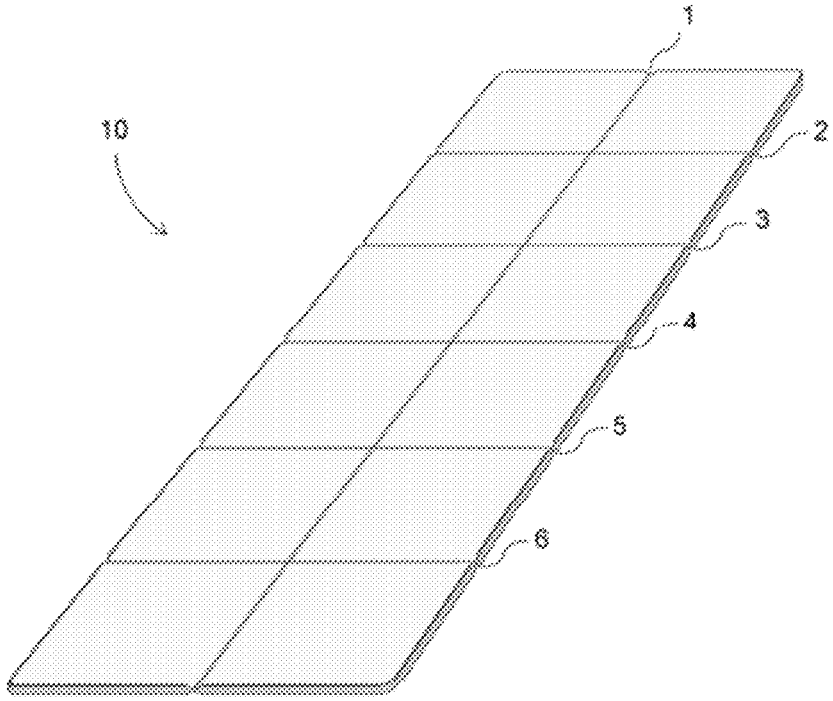
FIG. 1 is a perspective view of the front, top, and side of a portable, foldable yoga mat.

The yoga/meditation mat of the present invention, in general, includes a plurality of linear indentations which are embossed on the mat with at least one horizontal linear indentation and at least one vertical linear indentation. The linear indentations are embossed on the same piece of mat material from which the mat is manufactured and are created by using embossing techniques including high frequency embossing techniques, heat embossing techniques or other types of indenting techniques. In its broadest aspect, the plurality of linear indentations includes at least one (e.g., two or three) vertical linear indentations and at least one (e.g., two, three, four, five, six, or seven) horizontal linear indentations. As used herein, a "vertical linear indentation" refers to an indentation that is substantially parallel to a length of the mat in an unfolded state and a "horizontal linear indentation" refers to an indentation that is substantially parallel to a width of the mat in an unfolded state. Preferably, there could be one vertical linear indentation and four to six horizontal linear indentions to divide the mat into ten to fourteen rectangular or square shaped panels. In practice, the present invention can be used as a yoga mat when the mat is unfolded along all linear indentations, a meditation mat or sitting mat when the mat is unfolded along two or more horizontal linear indentations, a portable sized block when the mat is folded along all linear indentations for easy and effortless carrying and storing.

Referring now to the drawings, FIGS. 1-4 illustrate the practice of the invention wherein the yoga mat numbered 10 includes six linear indentations numbered 1-6 respectively. Yoga mats are generally rectangular but may come in other shapes and sizes. For illustrative purposes, one vertical linear indentation (numbered 1) and five horizontal linear indentations (numbered 2-6 respectively) are shown. Also for illustrative purposes, the linear indentations 1-6 are shown as embossed from both sides of the yoga mat 10, however in practice, the linear indentations could reside on one side or both sides of the yoga mat.

Yoga mat 10 can be made from any suitable materials such as polyvinyl chloride, thermoplastic elastomer, rubber, rubber-like material, ethylene vinyl acetate, polymer environmental-friendly resin, cotton, microfiber, polyester, wool or a moisture absorbent fabric. Preferably, one of the most popular yoga mat materials such as polyvinyl chloride (PVC) or rubber could be used because it has a non-slip surface as well as good elasticity and durability to have the linear indentations embossed on the surface for repeated folding and unfolding. Since yoga is often practiced with bare feet in positions demanding body balances, the surface of the yoga mat needs to be non-slip and often with patterns to prevent skidding. The present invention does not require any changes in choosing the yoga mat materials or surface patterns, and can be easily adapted to any existing yoga mat materials and surface patterns. Since the linear indentations are embossed on the same piece of material of the mat, they would preserve the desired qualities of the mat such as the patterns, the non-slip surface and the integrated feeling of the mat.

Yoga mat 10 can have a thickness of at least about 2 mm (e.g., at least about 3 mm, at least about 6 mm, or at least about 12 mm) and/or at most about 20 mm (e.g., at most about 18 mm, at most about 15 mm, or at most about 12 mm) in a completely unfolded state. Yoga mat 10 can have a width of at least about 40 cm (e.g., at least about 50 cm, at least about 60 cm, at least about 70 cm, or at least about 80 cm) and/or at most about 120 cm (e.g., at most about 110 cm, at most about 100 cm, at most about 90 cm, or at most about 80 cm) in a completely unfolded state. Yoga mat 10 can have a length of at least about 120 cm (e.g., at least about 150 cm, at least about 170 cm, at least about 180 cm, or at least about 190 cm) and/or at most about 250 cm (e.g., at most about 240 cm, at most about 230 cm, at most about 220 cm, or at most about 210 cm) in a completely unfolded state.

The linear indentations can be made with any suitable indenting techniques including embossing using high frequency embossing techniques or heat embossing techniques. The embossed linear indentations may take any suitable dimensions that make easy folding and unfolding. A typical unfolded yoga mat has a thickness of 3 mm (about ⅛ inch) to 12 mm (about ½ inch), with any mat thinner than 3 mm too thin to provide comfortable support for yoga practice. The linear indentations could take any suitable dimensions with adjustment made according to the mat thickness, mat material and construction. For example, for a relatively thin polyvinyl chloride (PVC) or rubber yoga mat measuring 3 mm (about ⅛ inch), the linear indentations could be embossed on one side of the mat with a 2 mm width and 1 mm depth to achieve easy folding. For a relatively thick PVC or rubber yoga mat measuring 12 mm (about ½ inch), the preferred linear indentations may measure at 20 mm width and 4 mm depth on each side of the mat. In some embodiments, the total depths of linear indentations can be from about ⅕ to about ⅘ (e.g., from about ⅕ to about ½ or from about ½ to about ⅘) of the thickness of the mat. However, it is to be noted that the dimensions of linear indentations are to ensure easy folding and unfolding of the yoga mat, and they could vary based on various factors such as thickness of the mat and the material of the mat. The embossing techniques preferred to be used in creating the linear indentations of the present invention could make easy adjustments to the dimensions of the indentations to achieve desired results.

Additionally, these linear indentations could be either embossed on both sides of the yoga mat or as illustrated in FIGS. 8-12 and FIG. 33, embossed on one side of the yoga mat. For example, for thinner mats that measure less than ¼ inch thick, easy folding and unfolding could be achieved without needing embossed linear indentations on both sides of the yoga mat. When embossing only on one side the of the yoga mat, the linear indentations could be embossed on either the side facing practitioner, thus providing visual or touch felt coordinates for body alignment; or on the side facing the ground, thus preserving the patterns of the entire mat surface facing the practitioner.

Figure 5:
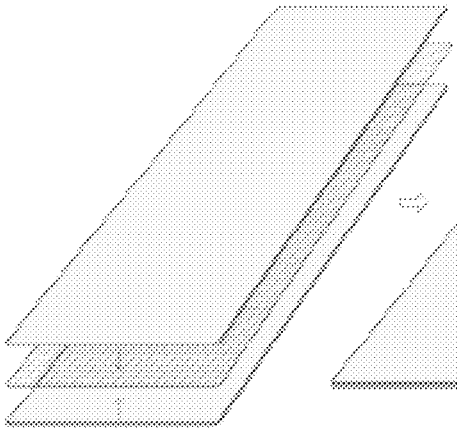
FIGS. 5-7 are perspective views of the invention, illustrating the different components and process in making one embodiment of the invention.
Figure 6:
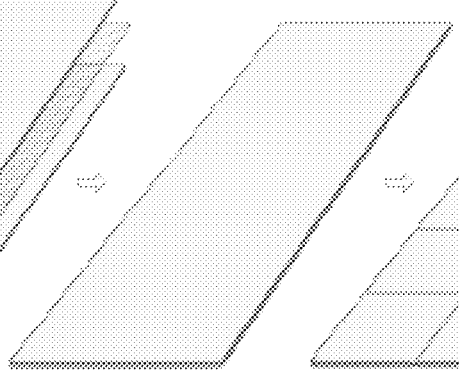
Figure 7:
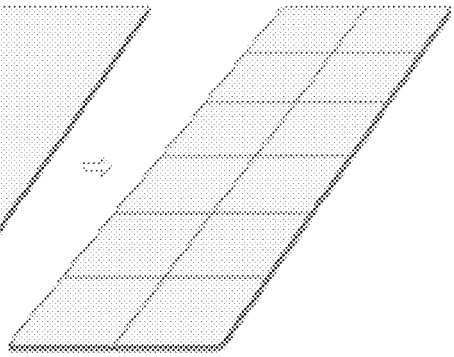
Figure 8:
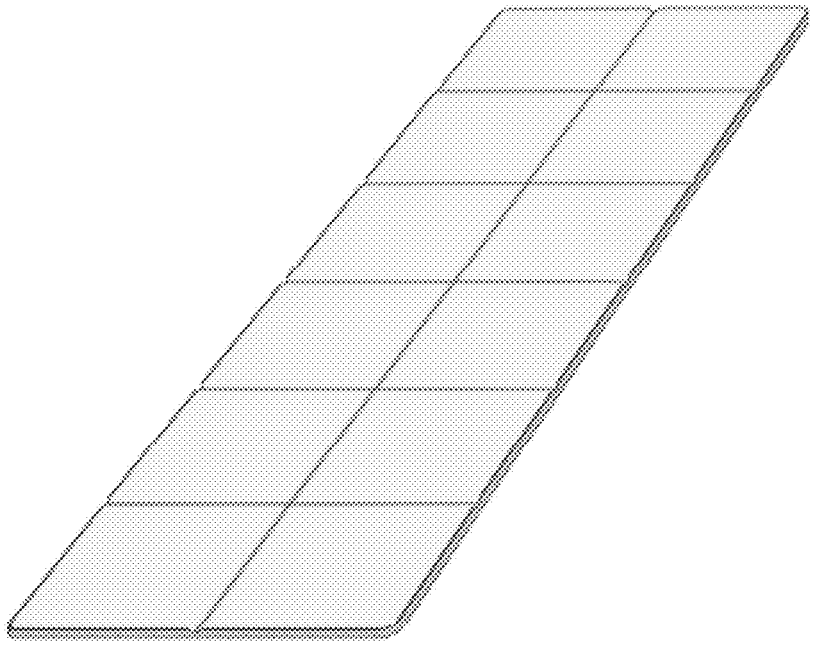
FIG. 8 is a perspective view of the front, top, and side of the invention, similar to FIG. 1, showing a different form of the invention with linear indentations on one side of the mat.
Figure 18:
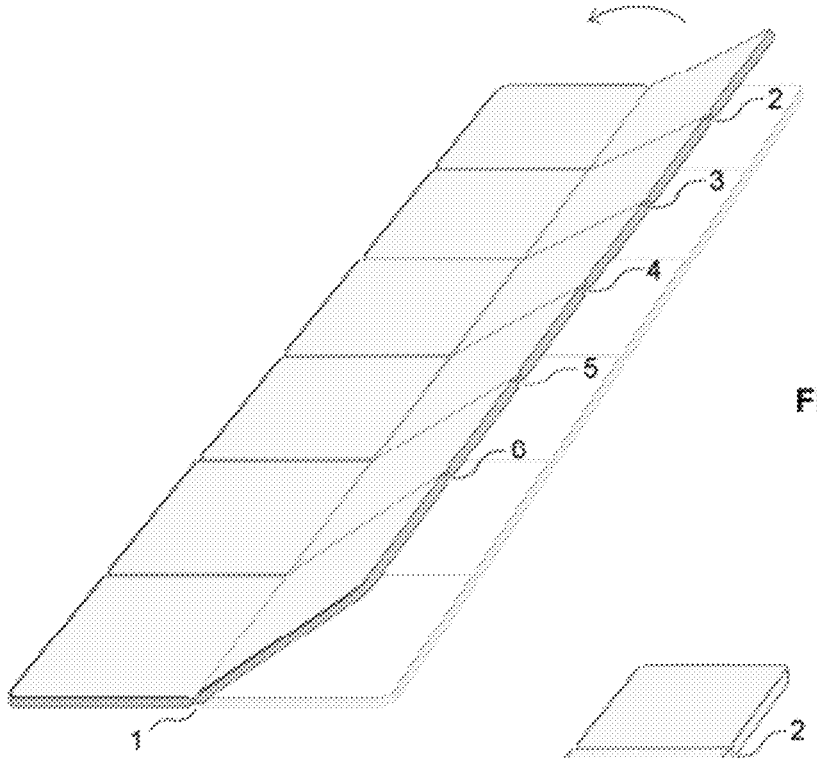
FIGS. 18-23 are perspective views of the invention, showing different forms of use.
Figure 19:
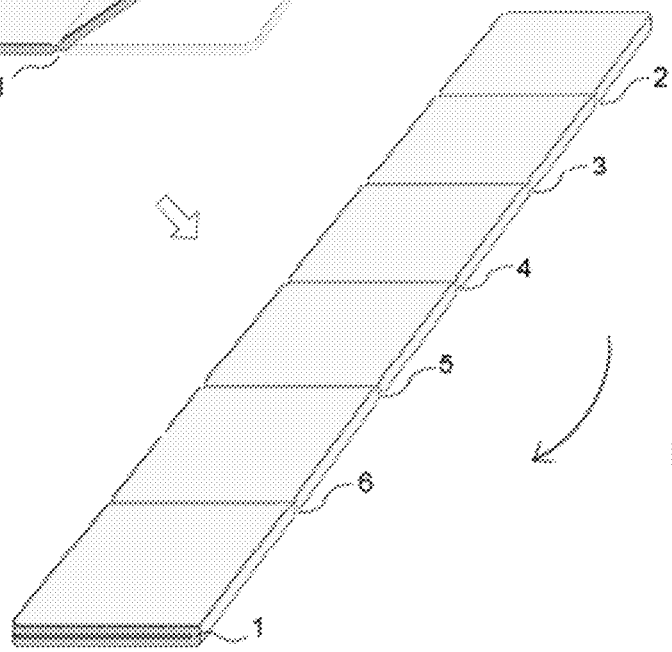
Figure 20:
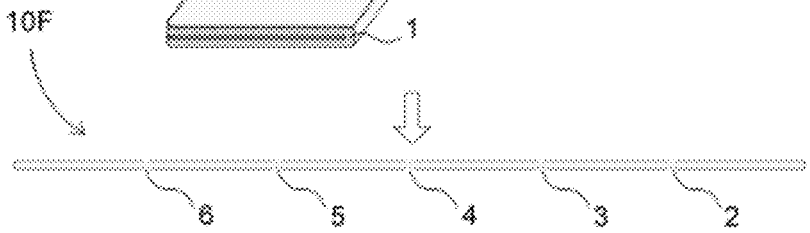
Figure 21:
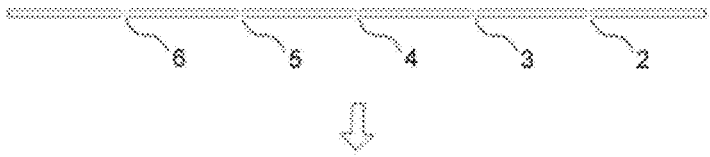
Figure 22:
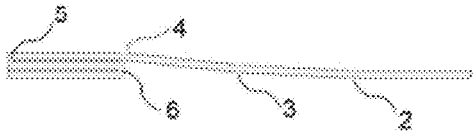
Figure 23:
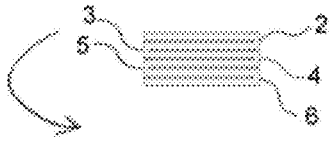

To further strengthen the yoga mat made from polyvinyl chloride, thermoplastic elastomer, rubber, polymer environmental-friendly resin or ethylene vinyl acetate, a middle layer of fabric made from polyester, nylon or a resilient fabric is inserted between and adhered to two layers of aforementioned mat material to prevent ripping at the folding lines (i.e. linear indentations). The linear indentations are then embossed on either the top or the bottom layer of mat material or on both layers with the depth of indentations not exceeding ⅘ of each of the layer of the mat material. FIGS. 5-7 illustrate the components and process in making a mat with a middle layer of fabric. As shown in FIG. 5, the middle layer of fabric in a net pattern is inserted between two solid layers of mat material. Then the top layer and bottom layer of mat materials are adhered to the middle layer of fabric by using a suitable adhering method such as gluing. The three layers then become one integral piece of yoga mat as shown in FIG. 6. The linear indentations are then embossed on the one piece mat material as shown in FIG. 7.

FIGS. 13-17 illustrate that yoga mat 10 shown in FIG. 1 is transformed into a meditation mat or sitting mat by folding the mat along some but not all linear indentations. One way of folding and transforming the mat is illustrated in FIGS. 13-16. As shown in FIGS. 13-14, the mat can be folded using two linear indentations 3 and 5, and leaving linear indentations 1, 2, 4, 6 unused. FIGS. 15-16 illustrate the transformed mat after folding linear indentations 3 and 5. If, for example, yoga mat 10 is measured at 69 inches long, 24 inches wide, and ¼ inch thick. Accordingly, the transformed mat would be about 23 inches long, 24 inches wide, and ¾ inch thick, which would make it a comfortable meditation mat. FIG. 17 shows a person practicing meditation on the partially folded, transformed meditation mat.

Figure 24:
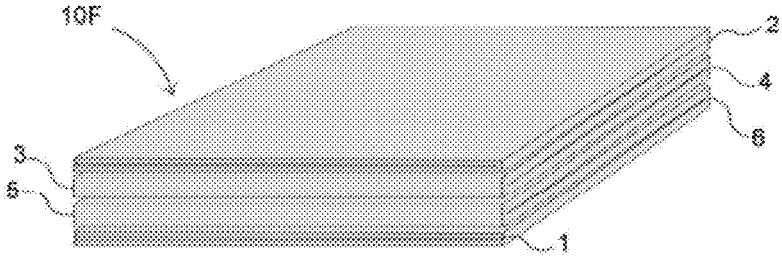
FIG. 24 is a perspective view of the invention, illustrated in an alternate, folded configuration.

FIGS. 18-24 illustrate that a mat of the present invention is rendered easily portable. One method of folding the mat is illustrated in FIGS. 18-23 by folding the vertical linear indentation 1 first, then horizontal linear indentations 2 through 6 by folding them one by one while alternating the folding direction between the odd numbered indentations and the even numbered indentations. The fully folded mat 10F is in the shape of a portable sized block as shown in FIG. 24. If, for example, yoga mat 10 is measured at 69 inches long, 24 inches wide, and ¼ inch thick. Accordingly, the fully folded mat 10F would be about 11.5 inches long, 12 inches wide, and 3 inches thick, which would make it easily carried in a non-customized bag, purse, tote, backpack etc. and easily stored by stacking them on top of each other or with other regular shaped items such as storage boxes.

In addition, as illustrated in FIGS. 18-24, folding of the present invention ensures one side of the mat does not touch the other side of the mat, thus achieving a hygienic design by preventing easy transmission of the germs/dirt on the floor to the side of the mat facing practitioner.

Figure 25:
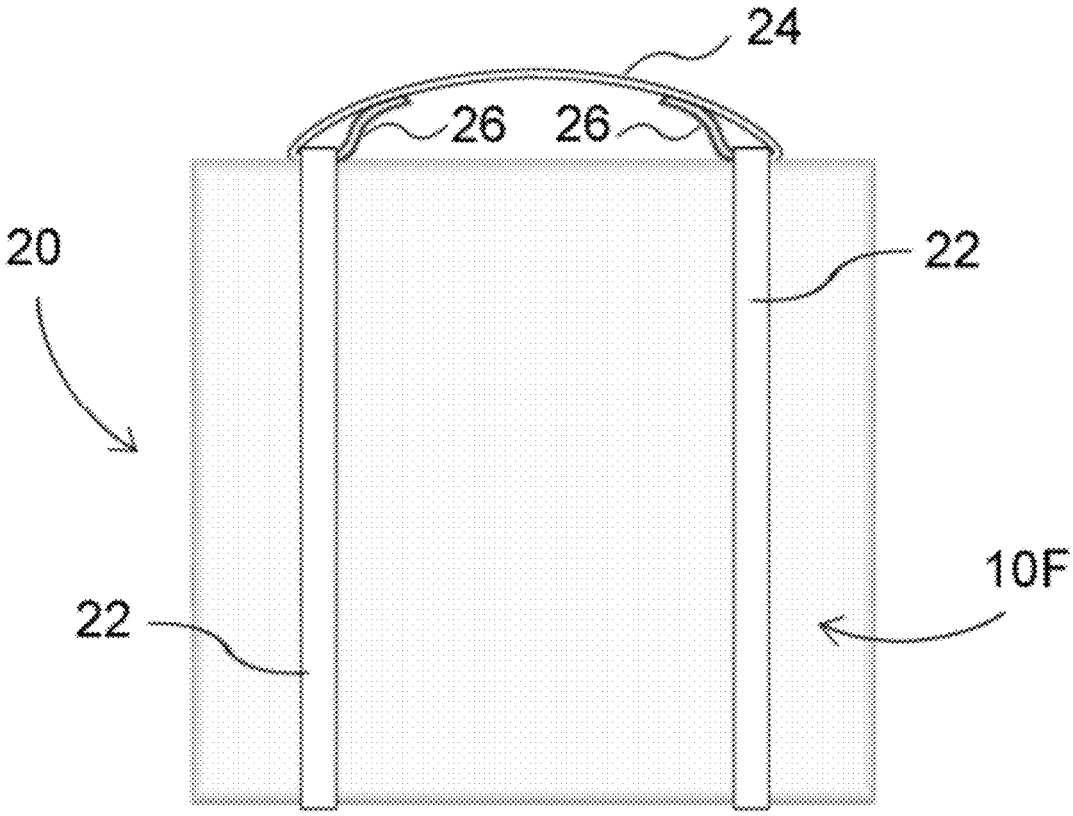
FIG. 25 is a side elevational view of the invention, illustrated in a folded configuration, in its portable position with customized straps.

FIG. 25 illustrates a further practice of the portability of the invention when using customized straps. As shown therein, a carrying arrangement 20 is provided in the form of a pair of straps 22 which would be secured around the folded mat 10F shown in FIG. 24 at each end thereof. In the preferred practice of this invention, straps 22 are made of hook and loop fasteners so that they can be suitably mounted in a convenient manner. Other fasteners could be used include buttons, snaps or tics. A carrying handle or strap 24 is provided at the upper end of the folded mat by inserting the straps 22 through loops 26 at each end of carrying handle 24.

Figure 26:
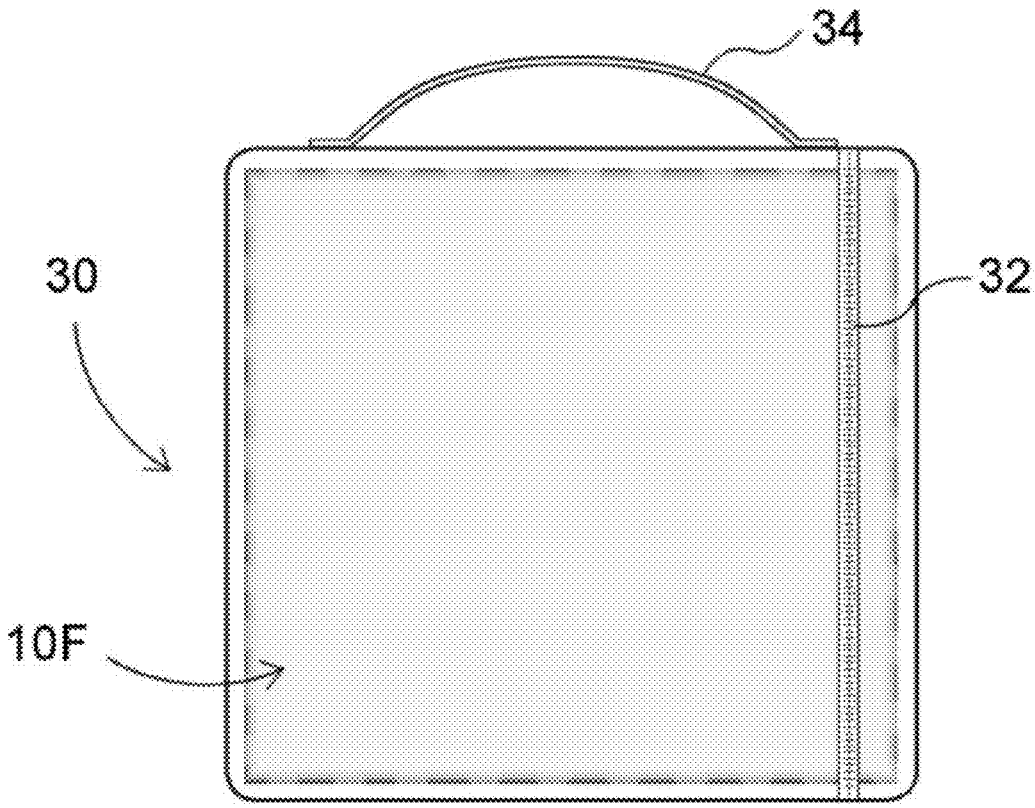
FIG. 26 is a side elevational view of the invention, illustrated in a folded configuration, in an alternate portable position with a customized carrier.
Figure 27:
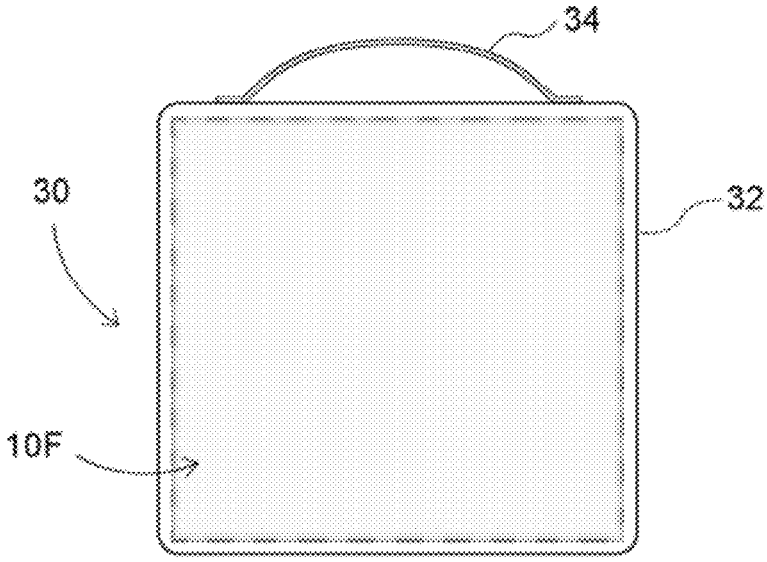
FIG. 27 is a side elevational view of the invention, illustrated in a folded configuration, in an alternate portable position with a second embodiment of a customized carrier.
Figure 28:
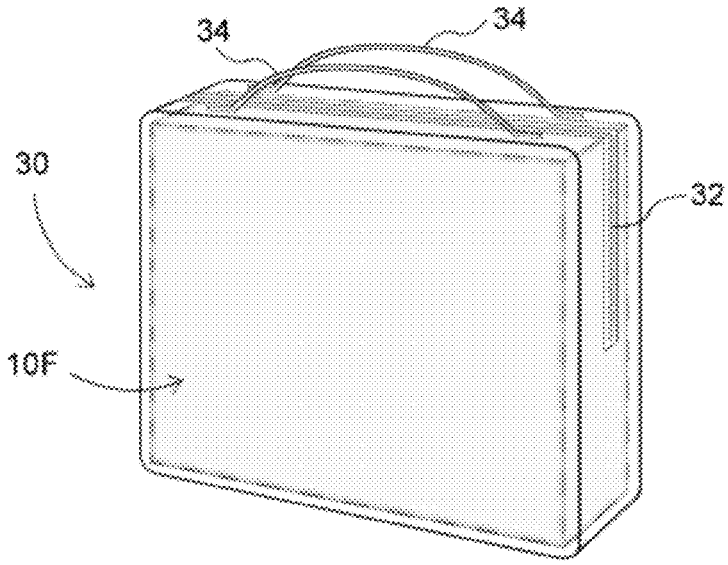
FIG. 28 is a perspective view of the invention, illustrated in a folded configuration, in an alternate portable position with a second embodiment of a customized carrier.

FIGS. 26-28 show a variation of the invention wherein the portability is effected by inserting the folded mat 10F shown in FIG. 24 in a carrier 30 which is provided with a zipper 32 to provide access to the interior of the cover. Carrier 30 has its own handle 34 which is preferably permanently attached to carrier 30 although a detachable handle may also be used. Carrier 30 could be made of any suitable lightweight but sturdy material capable of having the folded mat 10F inserted therein and then the carrier would be closed by zipper 32 so that it could be carried by handle 34. Zipper 32 could locate anywhere on cover 30 as long as it allows easy insertion of the folded mat. FIG. 26 and FIG. 28 show two possible positions of the zipper 32. In addition, zipper 32 could be replaced by any other suitable enclosing methods such as buttons.

Figure 29:
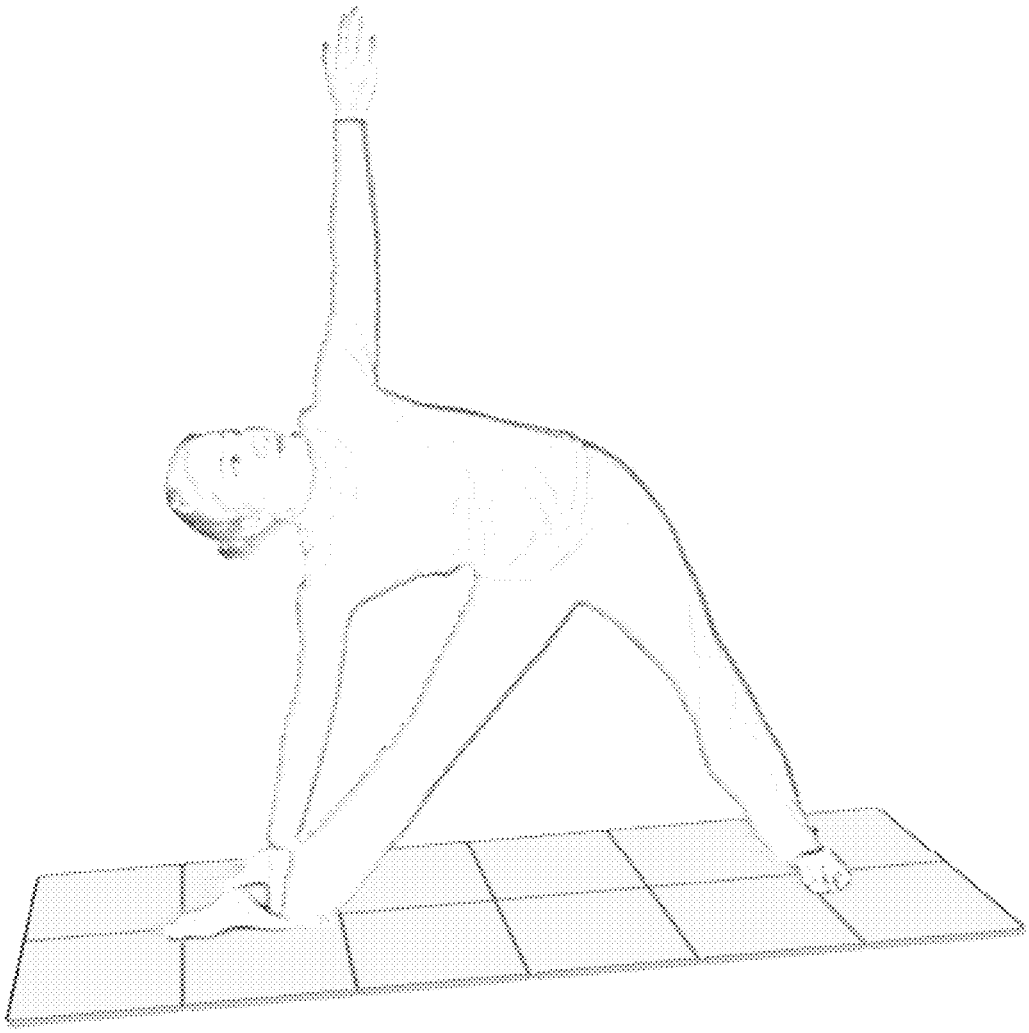
FIG. 29 is a perspective view of the invention, illustrated in an alternate, flat configuration with environment shown.

FIG. 29 shows the present invention in an unfolded manner with a person practicing yoga on it. The linear indentations on the mat can serve as visual or touch felt coordinates for body alignment in yoga practice.

Figure 30:
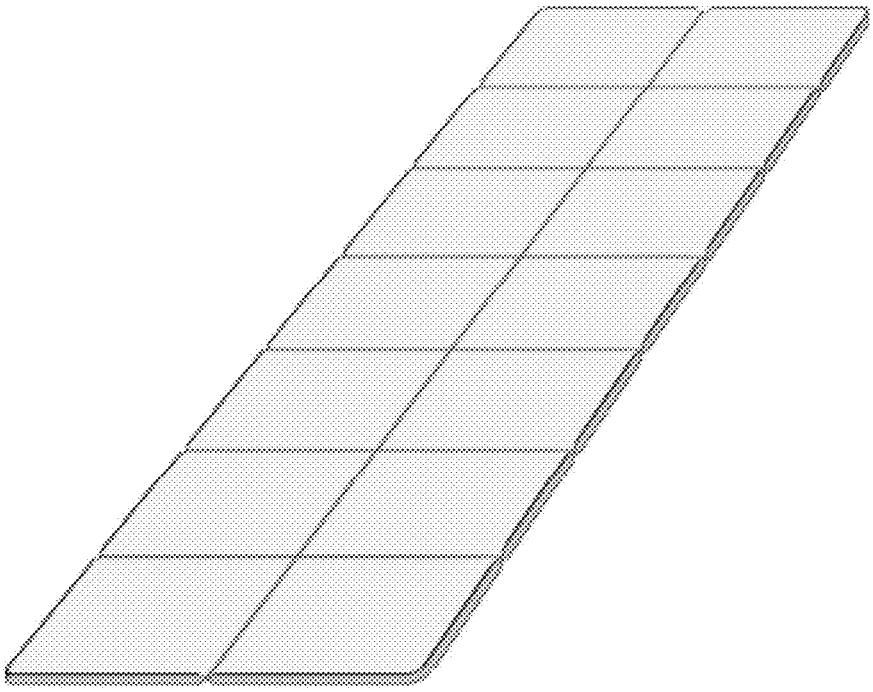
FIGS. 30-32 are perspective views of the front, top, and side of a portable, foldable yoga mat, similar to FIG. 1, showing different forms of the present invention.
Figure 31:
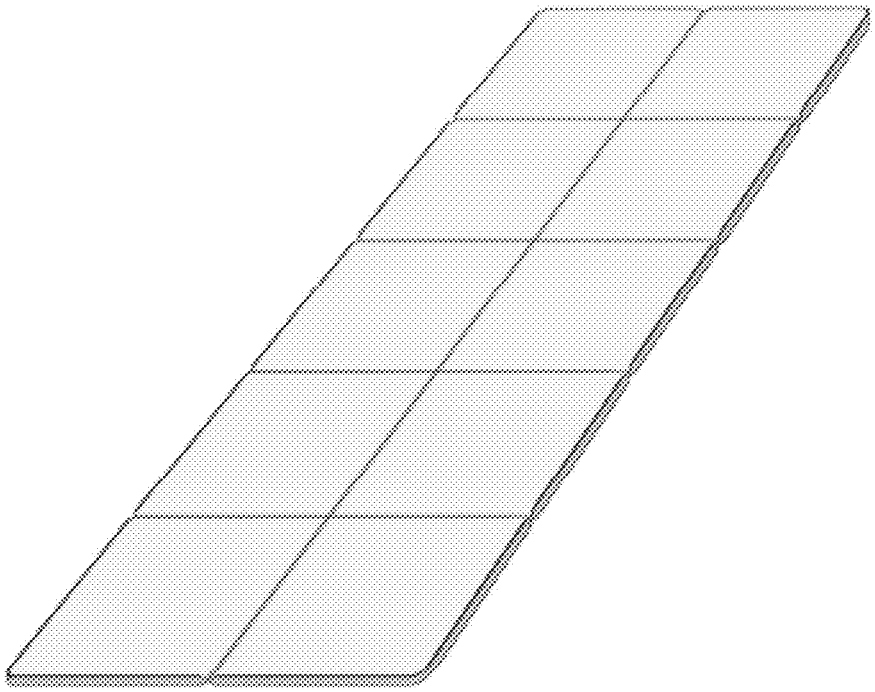
Figure 32:
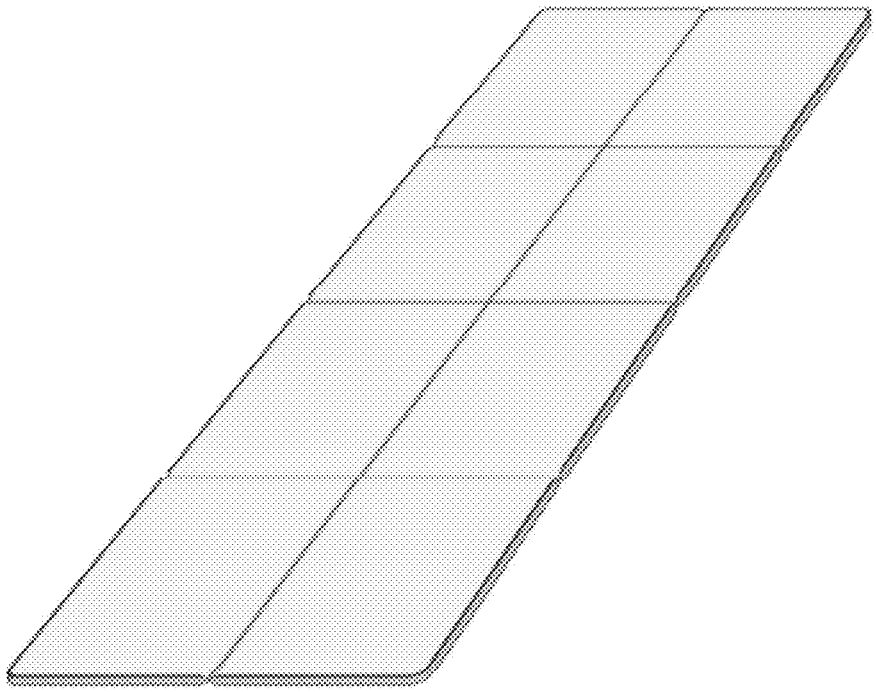
Figure 33:
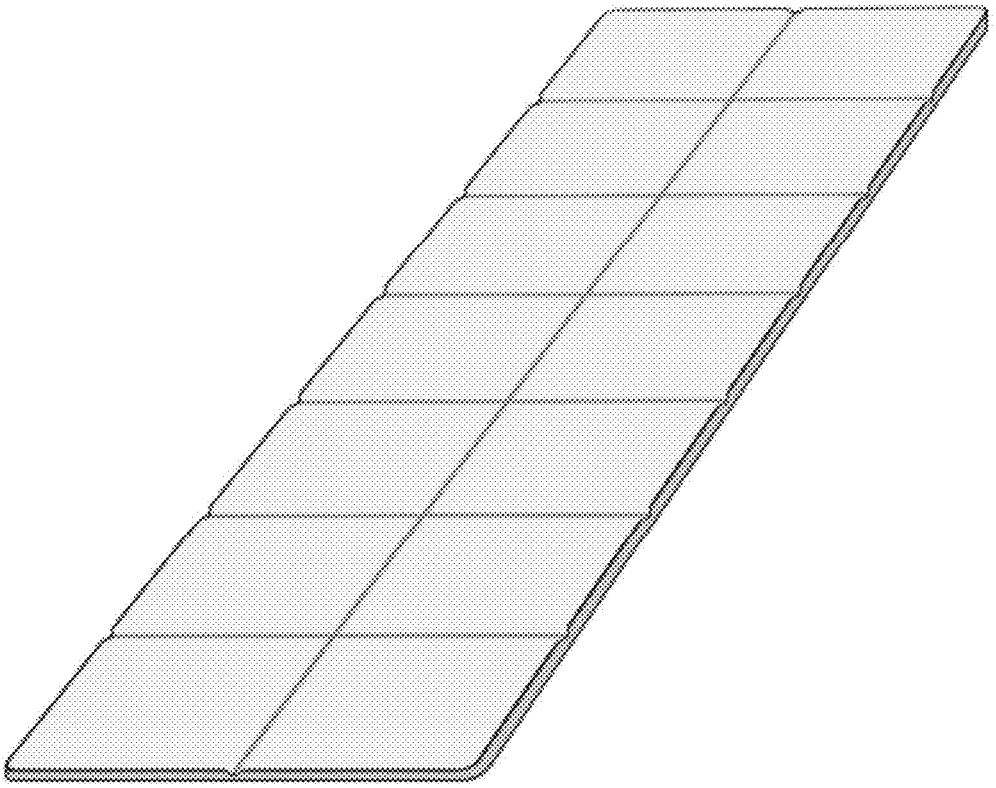
FIG. 33 is a perspective view of the front, top, and side of a portable, foldable yoga mat, similar to FIG. 8, showing different forms of the present invention with linear indentations on one side of the mat.

In some embodiments, FIGS. 30-32 illustrate different forms of the present invention, wherein FIG. 30 shows a mat that includes seven linear indentations, FIG. 31 shows a mat that includes five linear indentations and FIG. 32 shows a mat that includes four linear indentations, with indentations embossed on both sides of the mats shown in FIGS. 30-32.

As previously noted, this invention is capable of being carried out in various sizes and ways. The figures and descriptions shown here are for illustrative purposes only and should not be regarded as limiting.

The present invention of a foldable, portable yoga mat/meditation mat manufactured as described herein, thus provides convenient solutions to common problems such as carrying and storing the awkwardly shaped yoga mat as well as using separate yoga mat and meditation mat for the same session. Its portability can be achieved by inserting the folded mat into either non-customized bags, purses, totes, backpacks etc. or customized bags, covers and straps. Additionally, it is durable, comfortable, completely washable, and easily folded and unfolded using the linear indentations for effortless transformation. The present invention is also a hygienic design by preventing the side facing the floor touching the side facing the practitioner. The linear indentations or the folding lines on the mat can also serve as visual or touch felt coordinates to assist body alignment in yoga practice. The conveniences are achieved while preserving all the qualities needed from a yoga mat/meditation mat in yoga/meditation practices.

With respect to the above description then, it is to be realized that the optimal dimensional relationships for the parts of the invention, to include variations in size, materials, shape, form, function and the manner of operation and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since a number of modification and changes will readily occur to those skilled in the art, it is not desired to limit the invention to the exact construction and operation shown and described. For example, the present invention could be easily adapted as a mat for Pilates, stretching or other suitable exercises using a mat. Accordingly, all suitable modifications and equivalents may be resorted to, falling within the scope of the invention.

Having thus described the invention, I claim:

1. A yoga mat, comprising an elongated surface and a plurality of linear indentations embossed on the elongated surface extending into a depth of said elongated surface and not extending therethrough, the plurality of linear indentations comprising at least one linear indentation along the length and at least one linear indentation along the width, and the linear indentations rendering the yoga mat foldable;

wherein the mat comprises two layers of mat material and a middle fabric layer, the middle fabric layer is inserted between and adhered to the two layers of mat material.

2. The mat of claim 1, wherein the mat is made from polyvinyl chloride, thermoplastic elastomer, rubber, ethylene vinyl acetate, polymer environmental-friendly resin, cotton, microfiber, polyester, wool, or a moisture absorbent fabric.

3. The mat of claim 1, wherein the linear indentations are formed by using high frequency embossing techniques or heat embossing techniques.

4. The mat of claim 1, wherein when the mat is in a folded state, the mat is capable of being inserted into a customized bag, carrier or straps to be carried.

5. The mat of claim 1, wherein the mat is capable of being folded into different sizes using the linear indentations.

6. A yoga mat, comprising a one-piece mat body having a plurality of linear indentations extending into a depth of the mat and not extending therethrough, and a plurality of panels formed by the plurality of linear indentations, the plurality of linear indentations comprising at least one linear indentation along the length and at least one linear indentation along the width, wherein the mat is foldable along at least some of the linear indentations, the mat comprises two layers of mat material and a middle fabric layer, with the middle fabric layer being inserted between and adhered to the two layers of mat material.

7. The mat of claim 6, wherein the mat has a rectangular shape in an unfolded state.

8. The mat of claim 6, wherein the mat has a rectangular or square block shape in a folded state.

9. The mat of claim 6, wherein at least some of the plurality of panels have a rectangular shape.

10. The mat of claim 6, wherein all of the plurality of panels have a rectangular shape.

11. The mat of claim 6, wherein at least some of the plurality of panels have a square shape.

12. The mat of claim 6, wherein all of the plurality of panels have a square shape.

13. The mat of claim 6, wherein the mat has a major surface having a first surface area in an unfolded state, the mat has a major surface having a second surface area in a folded state, and the second surface area is at most about ⅓ of the first surface area.

14. The mat of claim 6, wherein the mat is made from polyvinyl chloride, thermoplastic elastomer, rubber, ethylene vinyl acetate, polymer environmental-friendly resin, cotton, microfiber, polyester, wool, or a moisture absorbent fabric.

15. The mat of claim 6, wherein the linear indentations are formed by embossing.

16. The mat of claim 6, wherein the linear indentations are formed by using high frequency embossing techniques or heat embossing techniques, or other suitable indenting techniques.

17. The mat of claim 6, wherein when the mat is in a folded state, the mat is capable of being inserted into a customized bag, carrier or straps.

18. The mat of claim 6, the mat is capable of being folded into different sizes.

* * * * *